US005951187A

United States Patent [19]

Hsieh

[11] Patent Number: 5,951,187

[45] Date of Patent: Sep. 14, 1999

[54] FLUID FLOW REGULATOR AND WRITING PEN

[75] Inventor: Hui-Huang Hsieh, Taipei, Taiwan

[73] Assignee: Ziber Co., Ltd., Taipei, Taiwan

[21] Appl. No.: 09/000,575

[22] Filed: Dec. 30, 1997

[51] Int. Cl.[6] ..... B43K 5/00

[52] U.S. Cl. ..... 401/199; 401/225; 401/227

[58] Field of Search ..... 401/199, 198, 401/209, 225, 227, 228, 229, 258

[56] References Cited

U.S. PATENT DOCUMENTS

| | | | |
|---|---|---|---|
| Re. 28,123 | 8/1974 | Di Carlo | 401/258 |
| 2,588,829 | 3/1952 | Greist | 401/209 |
| 3,951,555 | 4/1976 | Wittnebert | 401/199 |
| 4,382,707 | 5/1983 | Anderka | 401/198 |
| 4,671,692 | 6/1987 | Inaba | 401/199 |
| 5,829,904 | 11/1998 | Matsumoto et al. | 401/199 |

*Primary Examiner*—David J. Walczak
*Attorney, Agent, or Firm*—Foley & Lardner

[57] ABSTRACT

A fluid flow regulator for storing and returning excess fluid flow resulting from changes in atmospheric pressure and ambient temperature. The fluid flow regulator includes a continuous, uniform path having a triangular cross-sectional shape which particularly facilitates capillary attraction of the excess fluid.

14 Claims, 5 Drawing Sheets

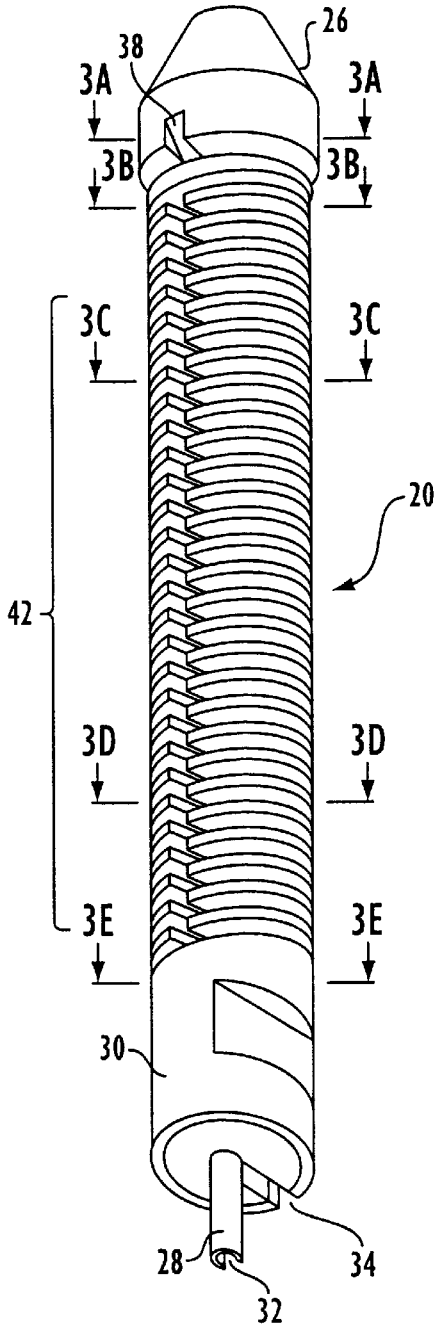
FIG. 2
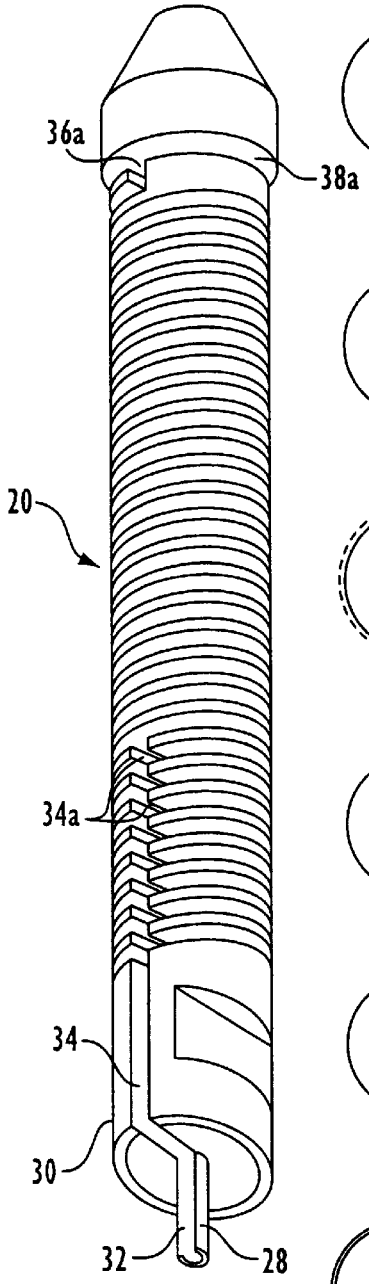
FIG. 3
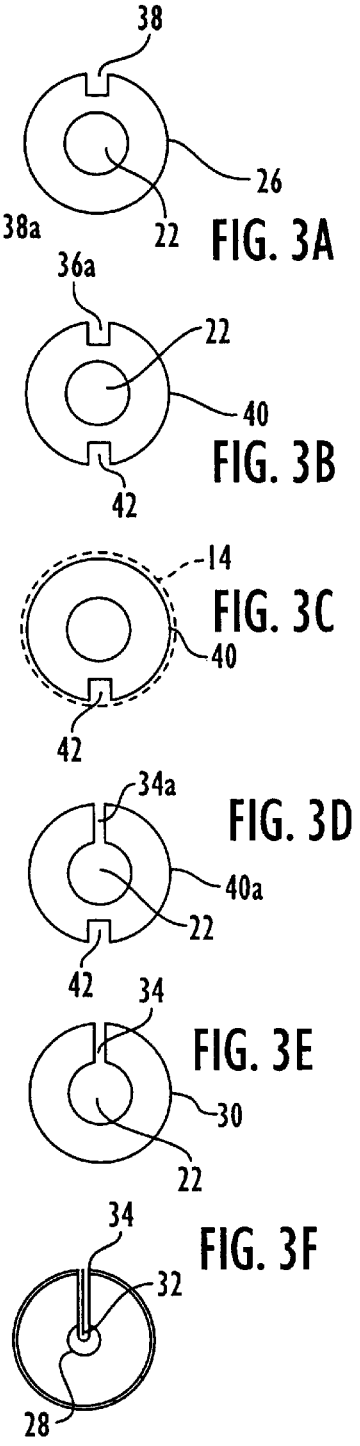
FIG. 3A
FIG. 3B
FIG. 3C
FIG. 3D
FIG. 3E
FIG. 3F FIG. 7A
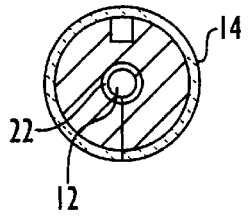
FIG. 7B
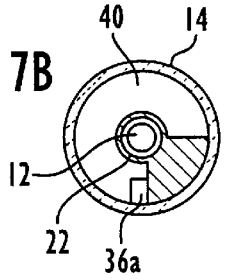
FIG. 7C
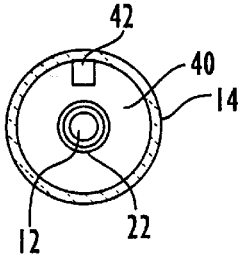
FIG. 7D
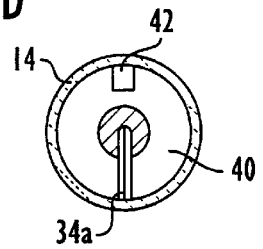
FIG. 7E
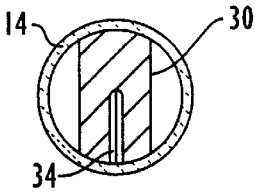
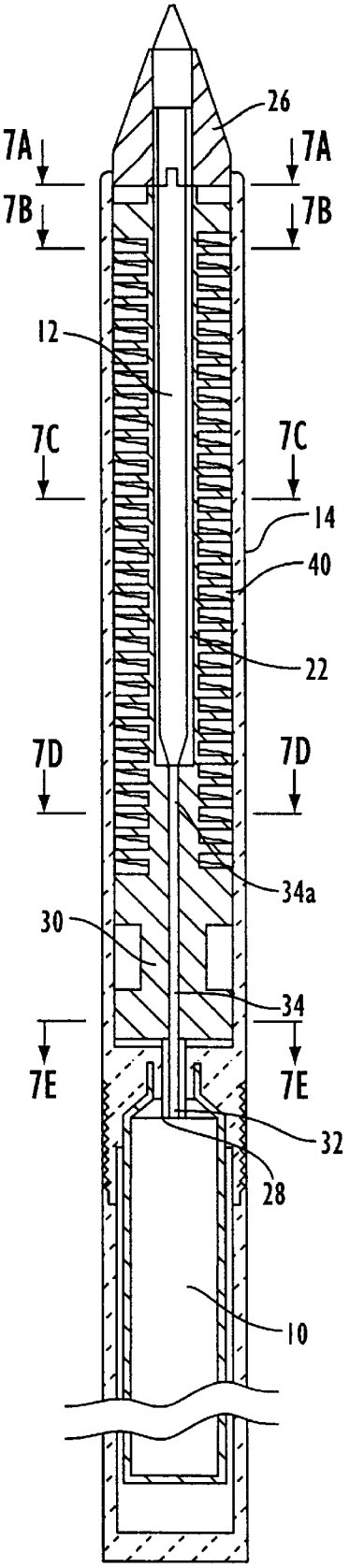
FIG. 7

FLUID FLOW REGULATOR AND WRITING PEN

BACKGROUND OF THE INVENTION

1. Field of the Invention

The present invention relates to a fluid flow regulator. More particularly, the present invention relates to an ink flow regulator and a writing pen having an ink flow regulator.

2. Description of Related Art

U.S. Pat. No. 4,382,707 to Anderka discloses a writing pen having a cylindrical body supporting a writing tip at an anterior end and an ink reservoir at a posterior end. The anterior end of Anderka's cylindrical body includes inner and outer pressure equalization chambers having interconnected posterior ends. Anderka's outer pressure equalization chamber includes an anterior communication to ambient air. Anderka specifically discloses passages having noncapillary rectangular cross-sections.

U.S. Pat. No. 4,671,692 to Inaba also discloses a writing pen having an ink flow regulator. Inaba's regulator has a plurality of circumferential fins that cooperatively define a labyrinth of separate chambers which are sequentially filled by excess ink. To ensure excess ink does not flow directly from the reservoir to the air vent located near the tip, Inaba's fin spacing is smallest near the reservoir and increases progressively, or in stages, toward the tip. Similar to Anderka, Inaba's chambers also have a rectangular cross-section that is not favorable to capillary attraction.

SUMMARY OF THE INVENTION

An object of the present invention is to provide a fluid flow regulator for supplying consistent fluid flow throughout a wide range of atmospheric pressure and ambient temperature conditions. The fluid flow regulator comprises a continuous fluid path for storing excess fluid flow caused by changes in atmospheric pressure or ambient temperature. In this case, "continuous" is defined as a constant rate of change for the direction vector of the path. The excess fluid is subsequently returned to a reservoir during stable atmospheric and temperature conditions.

According to the present invention, the fluid flow regulator comprises a helical fluid path having a generally triangular or V-shaped cross-section configuration. Such a configuration provides storage for excess fluid in a continuous passage with superior capillary attraction as compared to conventional regulators.

Another object of the present invention is to provide an ink flow regulator for a writing pen. Withdrawing ink reduces the pressure inside an ink reservoir thereby affecting ink flow. The present invention provides an air flow path to equalize the pressure inside the ink reservoir with the atmospheric pressure. Consequently, a writing pen according to the present invention provides a consistent ink flow.

Yet another object of the present invention is to provide an ink flow regulator which stores excess ink flow. The excess ink is subsequently returned to the ink reservoir, thereby avoiding ink leakage from the writing pen.

A further object of the present invention is to provide an ink flow regulator for different types of writing pens including those having a felt tip, a marking fiber nib, a stainless steel roller ball nib, or a fountain pen nib.

Yet a further object of the present invention is to provide an ink flow regulator which is readily manufactured by injection molding.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIGS. 1A–1E are cross-section views of the fluid flow regulator shown in FIG. 1.

FIG. 1F is a bottom view of the fluid flow regulator shown in FIG. 1.

FIG. 2 is a first perspective view of a fluid flow regulator according to the present invention.

FIG. 3 is a second perspective view of the fluid flow regulator shown in FIG. 2.

FIGS. 3A–3F are cross-section views of the fluid flow regulator shown in FIG. 3.

FIG. 7 is a cross-section view of a writing pen according to the present invention.

FIGS. 7A–7E are cross-section views of the writing pen shown in FIG. 7.

Throughout the drawings, the same features are given the same alpha-numerical indicator. The drawings are not drawn to scale.

DETAILED DESCRIPTION OF THE PREFERRED EMBODIMENTS

Figure 1:
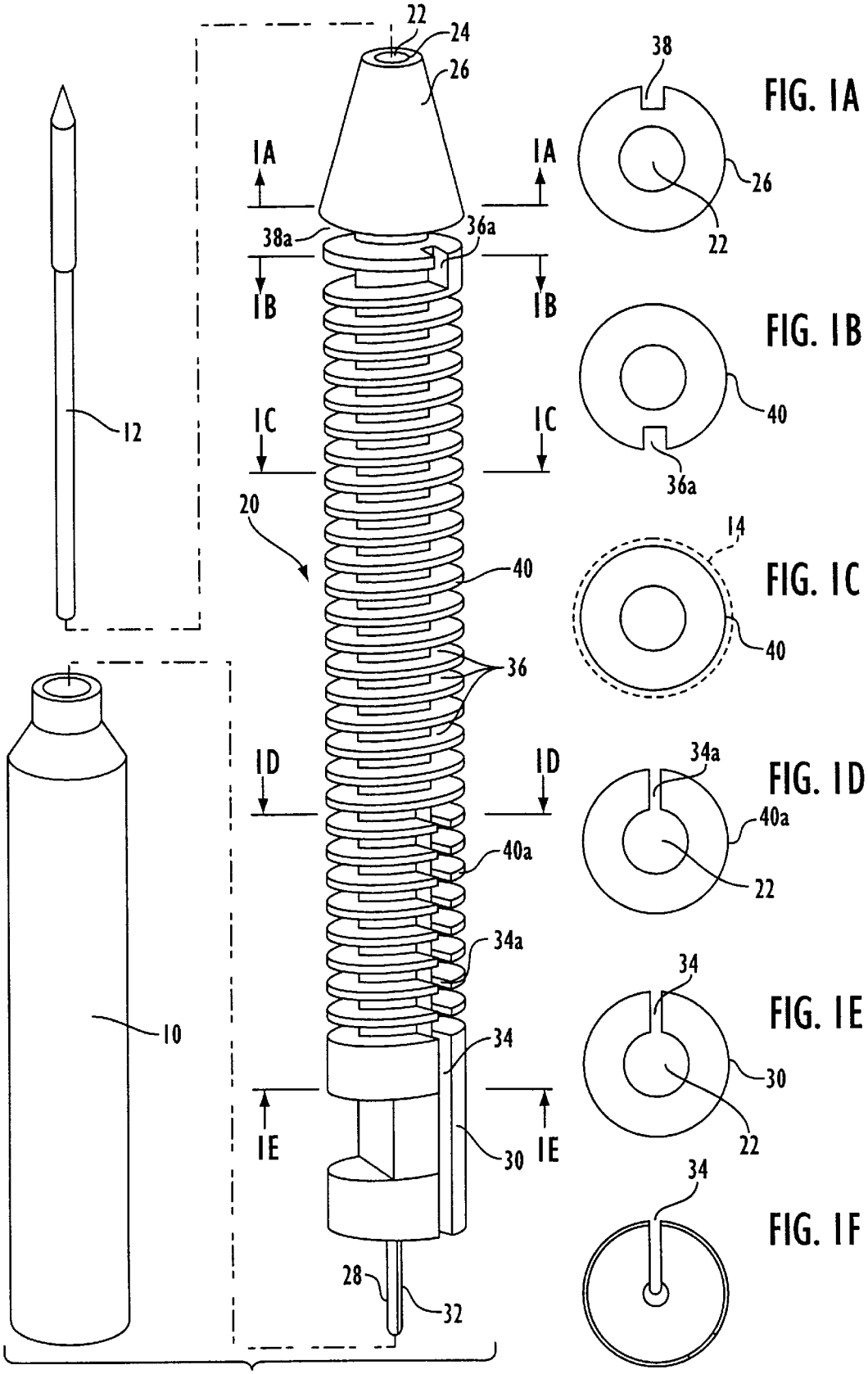
FIG. 1 is an exploded perspective view of the principle components of an ink pen according to the present invention.

An ink reservoir 10, a writing tip 12, and a fluid flow regulator 20 comprise the principle components of an ink pen according to the present invention as shown in FIG. 1. Ink reservoir 10 is a conventional replaceable ink cartridge or a conventional refillable ink chamber. The writing tip 12 may be of any conventional design including, but not limited to, a felt tip, a marking fiber nib, a stainless steel roller ball nib, or a fountain pen nib.

Fluid flow regulator 20 comprises a generally cylindrical body having an axial bore 22 for communicating ink from ink reservoir 10 to writing tip 12. Writing tip 12 extends into axial bore 22 through a fluid port 24 at a head or anterior end or anterior 26 of fluid flow regulator 20. A protrusion 28 from a tail or posterior end or posterior 30 of fluid flow regulator 20 receivably engages ink reservoir 10. A channel 32, having a generally triangular or V-shape cross-section is provided in protrusion 28 comprises another fluid port for communicating ink from ink reservoir 10 to axial bore 22. Ink is communicated by capillary attraction along a path from ink reservoir 10, via channel 32 and axial bore 22, to writing tip 12.

Reductions in atmospheric pressure and/or increases in ambient temperature cause excess ink flow from ink reservoir 10. According to the present invention, fluid flow regulator 20 stores the excess ink flow to ensure a consistent ink flow from writing tip 12. At such time as the atmospheric pressure and/or ambient temperature stabilize, fluid flow regulator 20 returns the accumulated excess ink flow to ink reservoir 10.

A description of the features of the present invention for regulating ink flow will now be described with reference to FIGS. 1 and 1A–1F.

To store the excess ink flow, fluid flow regulator 20 comprises a fluid path including a slot or opening 34 extending radially from axial bore 22 through tail end 30. One or more loops of a helical fluid path 36 extend around fluid flow regulator 20. Helical fluid path 36 is in fluid communication with radial slot 34 at tail end 30 and with a vent 38 at head end 26. One or more coils of a helical fin 40 demarcate helical fluid path 36 such that helical fluid path 36 extends around fluid flow regulator 20 in a single, continuous passage, i.e. without separate chambers or abrupt changes in direction.

As shown in FIGS. 1 and 1D, portions 34*a* of slot 34 may also extend radially from axial bore 22 through fluid flow regulator 20 so as to intersect one or more of the loops of helical fluid path 36. Portions 40*a* of helical fin 40 are established by slot 34*a*.

As shown in FIGS. 1 and 1B, an annular air chamber 38*a* and a connecting portion 36*a* may provide fluid communication between vent 38 and helical fluid path 36.

FIGS. 2 and 3 show a fluid flow regulator 20 per se according to the present invention. A vent channel 42 on an opposite side of fluid flow regulator 20 may provide direct communication across the coils of helical fin 40 for air from vent 38 to flow to slot 34. Whereas slot 34 penetrates fluid flow regulator 20 to axial bore 22, vent channel 42 is a notch in helical fin 40 which does not penetrate fluid flow regulator 20.

Figure 4:
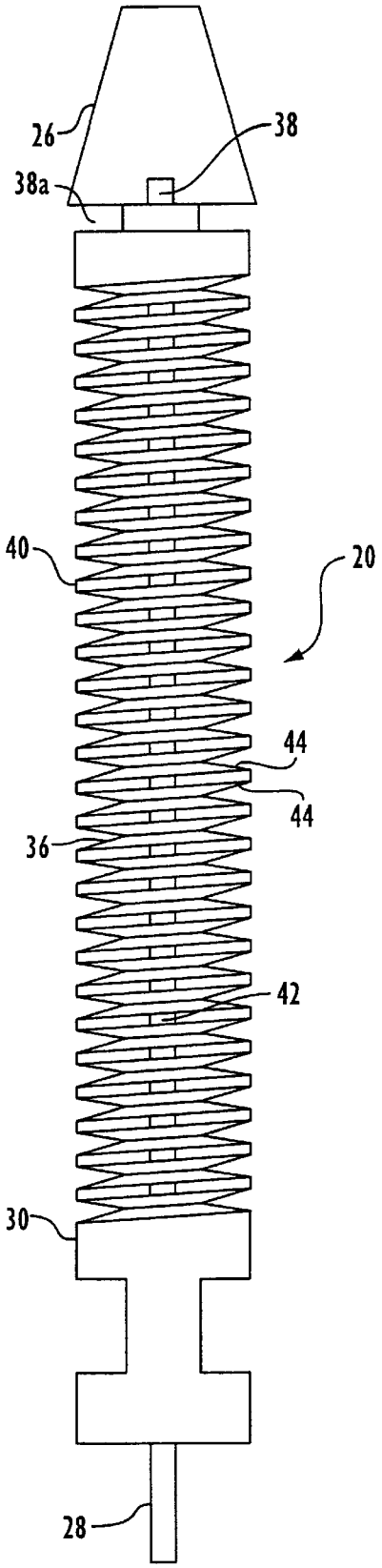
FIG. 4 is a front elevation view of the fluid flow regulator shown in FIG. 2.
Figure 5:
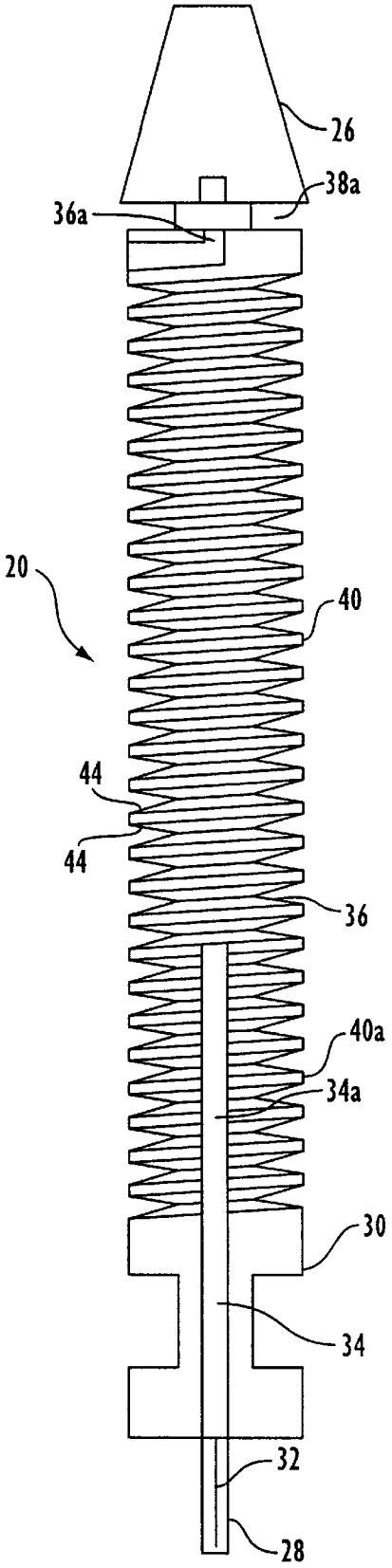
FIG. 5 is a back elevation view of the fluid flow regulator shown in FIG. 2.

FIGS. 4 and 5 particularly show the cross-section shape of helical fluid path 36 and helical fin 40 according to the present invention. Helical fluid path 36 has a triangular cross-section defined by relatively oblique sides 44 of helical fin 40. Such an arrangement has been determined by the inventors to particularly beneficial facilitating capillary attraction between the fluid in helical fluid path 36 and helical fin 40.

Figure 6:
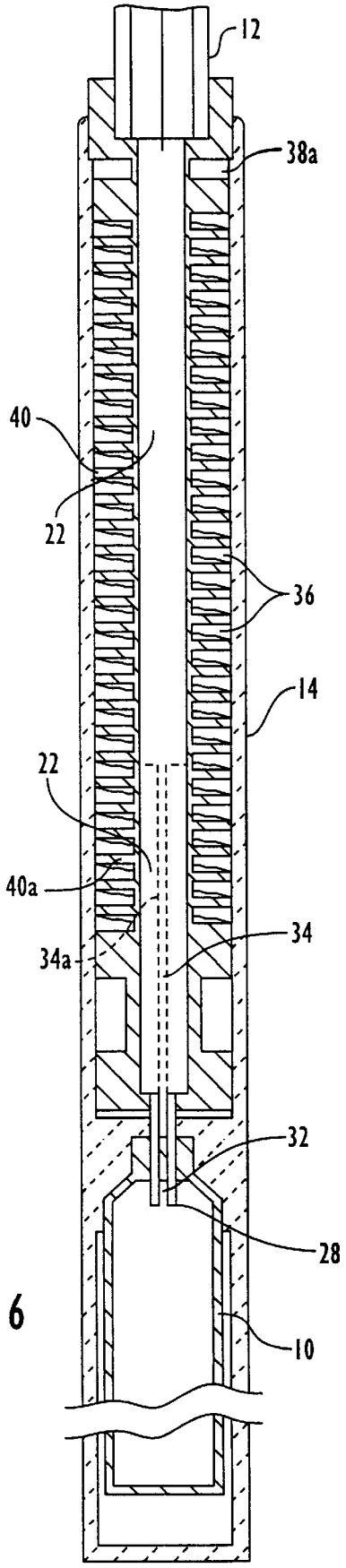
FIGS. 6 is a cross-section view of a writing pen according to the present invention.

FIGS. 6 and 7 show ink pens according to the present invention. FIGS. 7A–7E illustrate particular features of an ink pen according to the present invention. A housing 14 surrounds the principle components and forms the exterior body of the ink pen. As shown in FIG. 7, the cross-sectional size of axial bore 22 may be reduced in the region of radial slot 34.

Operation of fluid flow regulator 20 will now be described with respect to a writing pen. The primary flow path for ink is from ink reservoir 10, through axial bore 22, to writing tip 12. As ink is withdrawn from ink reservoir 10, reduced pressure in ink reservoir 10 tends to inhibit ink flow. To equalize the pressure in ink reservoir 10 with the atmospheric pressure, air enters vent 38, travels along helical fluid path 36, through slot 34 and channel 32, and enters ink reservoir 10.

Because channel 32 is small in cross-sectional size relative to axial bore 22, ink does not readily flow out of ink reservoir 10, but is instead withdrawn by capillary attraction to channel 32.

As a result of surface tension and known hydrostatic forces, ink only partially fills channel 32, beginning at the apex of the V-shape. This leaves sufficient room in channel 32 for air entering ink reservoir 10 to pass above the meniscus of the ink. Consequently, ink flow out of reservoir 10 and air flow into ink reservoir 10 occur concurrently.

Changes in atmospheric pressure and/or ambient temperature cause excess ink flow from ink reservoir 10. According to the present invention, excess ink flow is drawn by capillary attraction from axial bore 22, through radial slot 34, to helical fluid path 36. The presence of radial slot portion 34*a* further facilitates capillary attraction to helical fluid path 36. Similar to channel 32, radial slot 34 has a small cross-sectional size relative to axial bore 22 and helical fluid path 36. Consequently, helical fluid path 36 is progressively filled by capillary attraction of the excess ink flow to sides 44 of helical fin 40. The triangular cross-section of helical fluid path 36 particularly facilitates capillary attraction of the excess ink.

Subsequently, when the atmospheric pressure and ambient temperature have stabilized, the excess ink accumulated in helical fluid path 36 is returned by capillary attraction to ink reservoir 10.

Air for equalizing the pressure in ink reservoir 10 with the atmospheric air may flow through vent channel 42 and/or through a space between the meniscus of the excess ink and sides 44 in helical fluid path 36. Vent channel 42 has a substantially bigger cross-sectional size than radial slot 34 (15–20 times or more), thus there is no capillary attraction of the excess ink to vent channel 42.

Additional advantages and modifications will readily occur to those skilled in the art. Therefore, the invention in its broader aspects is not limited to the specific details, and representative devices, shown and described herein. Accordingly, various modifications may be made without departing from the spirit and scope of the general inventive concept as defined by the appended claims and their equivalents.

What is claimed is:

1. A regulator for controlling the flow of a fluid with respect to a fluid reservoir, comprising:

a cylindrical body having an axial bore adapted to be in fluid communication with the fluid reservoir, a first fluid port at a posterior end adapted to be generally proximate to the fluid reservoir, and a second fluid port at an anterior end adapted to be generally distal from the fluid reservoir;

a first fluid path adapted for supplying the fluid from the fluid reservoir, the first fluid path including the first fluid port, the axial bore, and the second fluid port;

a second fluid path adapted for storing and returning the fluid, the second fluid path including an opening at the posterior end of the cylindrical body, a helical fluid path extending from the opening at the posterior end in at least one loop around the cylindrical body, the helical fluid path having a generally triangular cross-section and being formed by a helical fin that extends in at least one coil around the cylindrical body, and a vent at a distal end of the helical fluid path with respect to the opening at the posterior end; and a vent channel connecting each loop of the helical fluid path with the vent.

2. The regulator according to claim 1, wherein the second fluid path further includes a vent path defined by a meniscus of the fluid in the second path.

3. The regulator according to claim 1, wherein the helical fin has relatively oblique generally oppositely facing sides.

4. The regulator according to claim 3, wherein confronting relatively oblique sides of adjacent coils of the helical fin form a substantially V-shaped cross section for receiving the triangular cross-section of the second fluid path.

5. The regulator according to claim 1, wherein the vent channel is formed by a notch in each coil of the helical fin.

6. The regulator according to claim 5, wherein the notches are aligned with respect to one another.

7. The regulator according to claim 1, wherein the cylindrical body further includes a protruding element for transferring the ink between the regulator body and the reservoir, the protruding element extending from the posterior end of the cylindrical body.

8. The regulator according to claim 7, wherein the opening at the posterior end of the cylindrical body includes a channel on the protruding element.

9. The regulator according to claim 8, wherein the opening at the posterior end of the cylindrical body has a relatively narrow width with respect to the second fluid path.

10. The regulator according to claim 8, wherein the first fluid path further includes the channel.

11. A regulator for controlling the flow of ink with respect to a reservoir, comprising:

a cylindrical body having an interior bore;

a first opening at a first end of the cylindrical body, the first opening being in fluid communication with the interior bore and adapted for receiving a writing tip;

a protruding element at a second end of the cylindrical body for engaging the ink in the reservoir;

a second opening at the second end of the cylindrical body, the second opening being in fluid communication with the protruding element;

a vent for connecting the reservoir to ambient conditions, the vent being located proximate the first end; and a helical fin extending on an exterior surface of the cylindrical body from the second opening to the vent, the helical fin having relatively oblique generally oppositely facing sides defining a V-shaped cross-section between adjacent coils of the helical fin.

12. A writing pen, comprising:

a reservoir for holding a supply of ink;

a writing tip for directing the ink onto a writing surface;

an ink flow regulator being interposed between the reservoir and the writing tip, the ink flow regulator including a primary ink channel for conveying the ink from the reservoir to the writing tip and a secondary ink channel in fluid communication with the reservoir, the secondary ink channel including a helical portion having a V-shaped cross-section for storing and releasing ink in response to changes in ambient conditions.

13. The writing pen according to claim 12, wherein the changes in ambient conditions include changes in atmospheric pressure and temperature.

14. The writing pen according to claim 12, wherein the primary ink channel includes an axial bore in the ink flow regulator, and the secondary ink channel includes a generally radial aperture in the ink flow regulator body.

* * * * *